US006874829B2

(12) United States Patent
Müller

(10) Patent No.: US 6,874,829 B2
(45) Date of Patent: Apr. 5, 2005

(54) INNER ACTUATOR FOR AUTOMOBILE DOOR LOCKS

(75) Inventor: Günther Müller, Würzburg (DE)

(73) Assignee: ITW Automotive Products GmbH & Co. KG, Iserlohn (DE)

( * ) Notice: Subject to any disclaimer, the term of this patent is extended or adjusted under 35 U.S.C. 154(b) by 116 days.

(21) Appl. No.: 10/118,890

(22) Filed: Apr. 10, 2002

(65) Prior Publication Data

US 2002/0148167 A1 Oct. 17, 2002

(30) Foreign Application Priority Data

Apr. 14, 2001 (DE) ..... 101 18 658

(51) Int. Cl.[7] ..... E05B 3/00

(52) U.S. Cl. ..... 292/336.3; 292/DIG. 22; 292/347

(58) Field of Search ..... 292/336.3, 347, 292/DIG. 22; 16/35 A, 412, 438

(56) References Cited

U.S. PATENT DOCUMENTS

| | | | | |
|---|---|---|---|---|
| 1,688,472 A | * | 10/1928 | Shaw | |
| 2,763,888 A | * | 9/1956 | Billeter | 16/59 |
| 2,851,296 A | * | 9/1958 | Guyaz | 292/78 |
| 3,025,091 A | * | 3/1962 | Peras | 292/139 |
| 4,540,208 A | * | 9/1985 | Logan et al. | 292/341.19 |
| 5,005,885 A | * | 4/1991 | Kobayashi et al. | 292/336.3 |
| 5,092,642 A | | 3/1992 | Lindmayer et al. | |
| 5,219,192 A | * | 6/1993 | Berger | 292/173 |
| 5,531,489 A | | 7/1996 | Cetnar | |
| 5,743,575 A | * | 4/1998 | McFarland | 292/336.3 |
| 6,264,257 B1 | * | 7/2001 | Meinke | 292/336.3 |
| 6,367,124 B1 | * | 4/2002 | Bella | 16/412 |
| 6,397,436 B1 | * | 6/2002 | Wang | 16/445 |
| 6,460,904 B1 | * | 10/2002 | Stapf | 292/336.3 |

FOREIGN PATENT DOCUMENTS

| | | |
|---|---|---|
| DE | 42 33 037 | 4/1994 |
| DE | 199 07 683 | 8/2000 |
| DE | 199 07 683 A 1 | 8/2000 |
| DE | 199 07 883 A 1 | 8/2000 |
| EP | 0 771 971 | 5/1997 |

OTHER PUBLICATIONS

Patent Abstracts of Japan, Pub. # 01250571, May 10, 1989, for Door Handle Device.

* cited by examiner

*Primary Examiner*—Gary Estremsky
(74) *Attorney, Agent, or Firm*—Lowe Hauptman Gilman & Berner LLP

(57) ABSTRACT

An inner actuator for automobile doors includes a lever-like handle adapted to be pivoted about an axis within a housing which is attached to the door, a linkage or an actuating cable which is led to a door lock and engages the handle, a spring which biases the handle into a rest position, a damper which is connected to a portion of the handle such that the movement of the handle into the rest position is damped, whereby a linear damper is provided which is linked to the door with one end and to a portion of the handle with the other end.

25 Claims, 2 Drawing Sheets

INNER ACTUATOR FOR AUTOMOBILE DOOR LOCKS

FIELD OF THE INVENTION

This invention relates to an inner actuator for automobile doors which includes a damping mechanism.

BACKGROUND ART

DE 199 07 883 has made known an inner actuation means for doors wherein a lever-like handle is supported so as to be pivotable about an axis within a housing which, in turn, is attached to the door. A portion of the handle is connected to the door lock via a linkage or actuating cable. A spring biases the handle into a rest position. A portion of the handle is toothed and engages with a pinion which is seated on the axle of a silicone rotary damper. Such an assembly efficiently meets the purpose of damping the pull-back motion of the door inside lever. The assembly described has a fixed geometrical association of its parts or components. Frequently, there is not sufficient space to integrate the known inner actuation means for doors in the automobile door.

SUMMARY OF THE INVENTION

It is the object of the invention to provide a low-noise inner actuation means for doors of automobiles which is small in construction and is adapted to be integrated into any configurations of a door.

The inner actuation means for doors according to one aspect of the present invention provides a linear damper which is fixedly attached to the door at one end and is hinged to a handle portion at the other end. The linear damper is preferably a so-called air damper which is preferably fitted with a free-moving device. Such air dampers are known as such. They mostly use a sealing member which is very permeable to air in one direction and is hardly permeable to air in the other direction. Air dampers have a number of advantages.

Because of its geometrical set-up, an air damper has an integrated free-moving device which can be employed for the direction of handle actuation. Furthermore, an air damper is easier to manufacture with less expenditure than a so-called silicone damper (rotary damper) having a free-moving device. An air damper is nearly independent on temperature. Its temperature dependence caused by different expansion coefficients of the parts it uses is negligible. A silicone damper the viscosity of which governs the braking torque features a heavy dependence on temperature. If there are below-zero temperatures the handle will be restored distinctly more slowly, which does not allow to close the door quickly.

Finally, a linear damper has the advantage to be disposable at many points adjacent to the inner actuation means for doors, e.g. on the housing of the handle, the sheet of the door, the door trimming, etc. According to an aspect of the invention, the working directions of the linkage or cable, on one hand, and the linear damper, on the other, are approximately parallel. A particularly space-saving solution is obtained, as a result.

It is understood that an air damper can be disposed to react to a pressure or pull. If it is disposed to react to pressure the restoring forces which can be absorbed are higher than those for a reaction to a pull.

According to a particularly advantageous aspect of the invention, the restoring spring is disposed in the housing of the air damper. The spring may be a simple compression spring which is easier to manufacture and mount than are the common leg springs on the axle of the inner actuation means for doors. Since the latter constitutes a potential source of noise the inventive configuration largely suppresses the formation of noise, particularly if a spring is used the wire of which is encased in plastic, in another aspect of the invention.

The invention also provides a rotary damper which is fixedly attached to the door remote from the handle and has a pinion, and a portion of the handle has hinged thereto a toothed rack which is guided by a guide means, the guide means holding the toothed rack in engagement with the pinion. This inventive solution also helps obtain a space-saving construction which is adaptable to any spatial conditions. Thus, the silicone damper may be mounted on a location remote from the handle. Since the guide causes the toothed rack to engage the pinion any tolerances of the handle shell, axle bearing, and handle are insignificant. Using a guide also allows the toothed rack to engage the pinion at a low noise.

Embodiments of the inventions will now be explained in more detail with reference to the drawings.

DETAILED DESCRIPTION OF THE INVENTION

The components of the inner actuation means for doors which are shown in the Figures, in structure and arrangement, are the same as those described in DE 199 07 683. Therefore, reference is explicitly made to this document.

Figure 1:
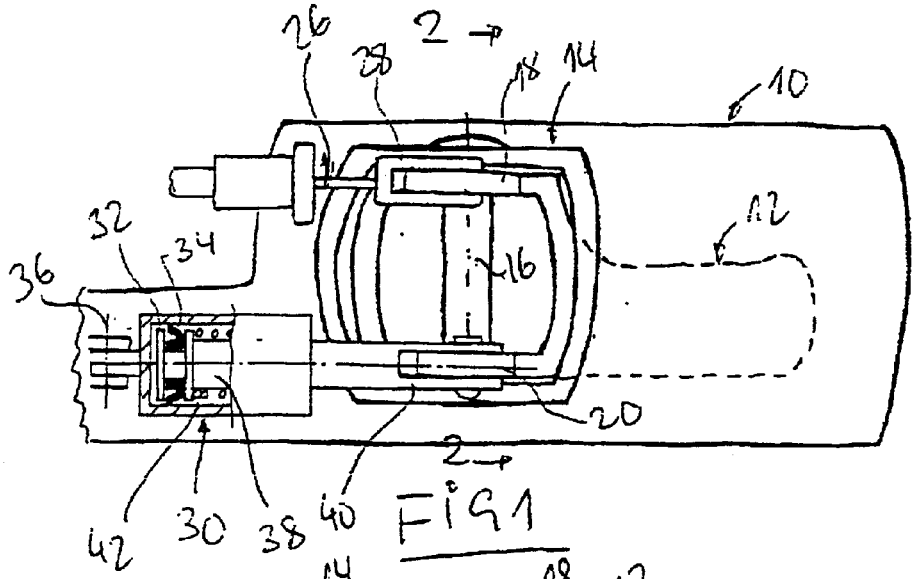
FIG. 1 schematically shows an inner actuation means for doors as seen from outside with a linear damper according to the invention.

Referring to FIG. 1, a shell 10 is outlined which is set into the inner trimming of an automobile door (not shown). An actuation lever 12 is located within the shell 10 and, therefore, is partially shown in phantom lines in FIG. 1. It extends towards the outer surface of the door through the shell 10 into a housing 14 which retains a bearing pin 16. The bearing pin 16, which is vertically disposed in the present case, pivotally supports the actuation lever 12. The actuation lever 12 has two legs 18, 20 which are linked to each other via a bent portion 22.

Legs 18, 20 have apertures through which the bearing pin 16 extends. The leg 18, for example, has hinged thereto a pulling cable of a cable 26 mechanism via a hole 24 as can be seen in FIG. 1. Connected to the cable is a U-shaped component 28 which is hinged to the leg 18 via a pin link or the like. Thus, actuating the lever 12 results in an actuation of the cable 16 and, hence, an operation of a lock (not shown) of the door.

FIG. 1 further illustrates a linear air damper 30. The air damper 30, which is of a design known as such, has a piston 32 with a ring seal 34 which is configured such as to cause the air damper to let pass more air in one direction and to let pass less air in the other direction, thus effecting a damping action in one direction and causing a free motion in the other. The air damper 30 is hinged to the shell 10 at 36. It is understood that it can also be fixedly hinged to the sheet of the door on the door trimming or another component. Thus, the position of the damper 30 is relatively random. In the case shown, the axle of the damper 30 is approximately parallel to the working direction of the cable 26, which saves particularly much space.

The piston rod 38 is led out of the housing of the damper 30 and is designed in a fork shape at 40 at the end in order to be hinged to leg 20 of lever 12. A restoring spring 42 for the lever 12, e.g. a compression spring, is seated on the piston rod 38 in the housing. This way realizes a low-noise arrangement of the spring, particularly if the spring is made of a plastic-coated wire.

Figure 2:
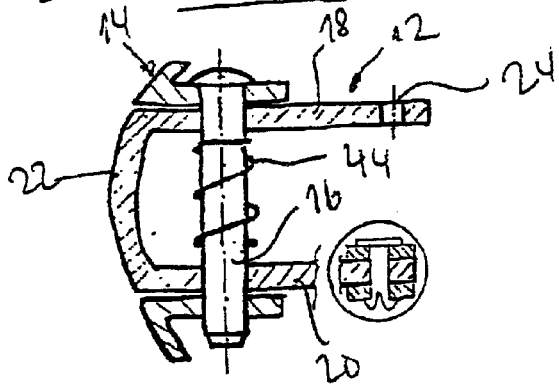
FIG. 2 shows a section taken through the assembly of FIG. 1 along lines 2—2.

The illustration of FIG. 2 is merely intended to elucidate the structure of the lever 12 and housing 14 with a restoring spring 44, however, being disposed on the bearing pin 16 in contrast to FIG. 1.

Figure 3:
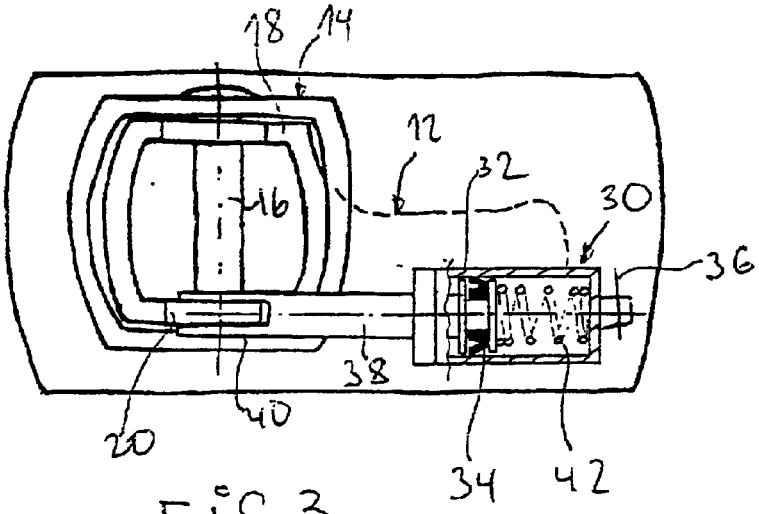
FIG. 3 shows an assembly similar to that of FIG. 1, but with the linear damper placed at a different point.

FIG. 3 illustrates the same components as does FIG. 1. Therefore, they are given the same reference numbers. The only distinction from FIG. 1 is that the linear damper 30 is disposed on the opposite side. The restoring spring 42 is a tension spring, for example. The embodiment of FIG. 4 also provides nearly the same parts as in the embodiment of FIG. 1. Therefore, the same reference numbers are used again. However, a restoring spring 44 is disposed on the bearing axle 16 like in FIG. 2. It further is apparent from FIG. 4 that a toothed rack 50 is hinged to the leg 20 at 52. The toothed rack extends through a guide 54 which is mounted on a rotatably supported rotary damper 56 that has a pinion 58. Such rotary or silicone dampers are generally known. Actuating the lever 12 moves the toothed rack 50 linearly and pivots it simultaneously. The guide 54 joins this pivoting motion while ensuring that the teeth 58 of the toothed rack 50 is in permanent engagement with the pinion 58. The toothed rack 50 and the pinion 58 are preferably made of plastic to bring about a low-noise interengagement.

Figure 4:
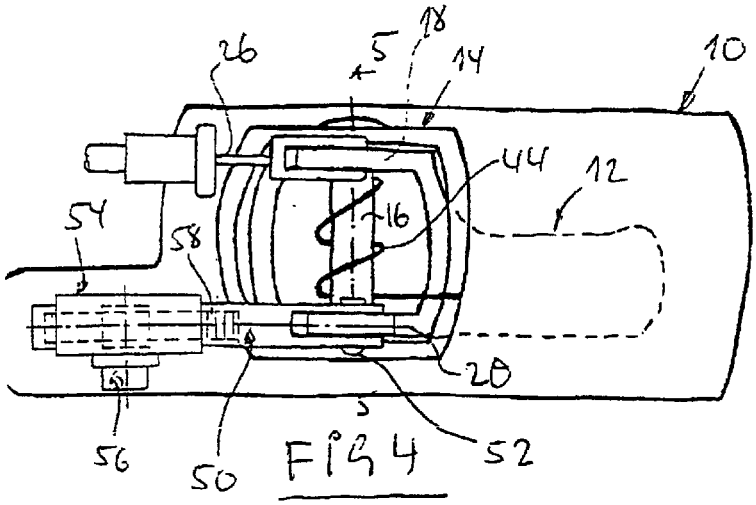
FIG. 4 shows an assembly of an inner actuation means for doors similar to that of FIG. 1, but with a rotary damper.
Figure 6:
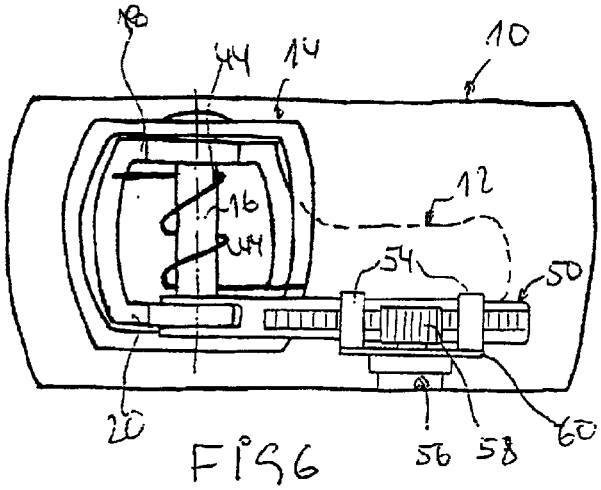
FIG. 6 shows an assembly similar to that of FIG. 4, but with the rotary damper placed at a different point.

The distinction of the embodiment of FIG. 6 from that of FIG. 4 is that the toothed rack 50 is disposed on the side opposed to that of FIG. 4. However, the remaining components are the same except for the guide 54 which, in the embodiment of FIG. 6, is composed of two guide portions which are pivotally or rotatably supported about the rotary damper 56 via a joint structural member 60 in order to join the pivoting motion of the toothed rack 54 when it is actuated.

Figure 5:
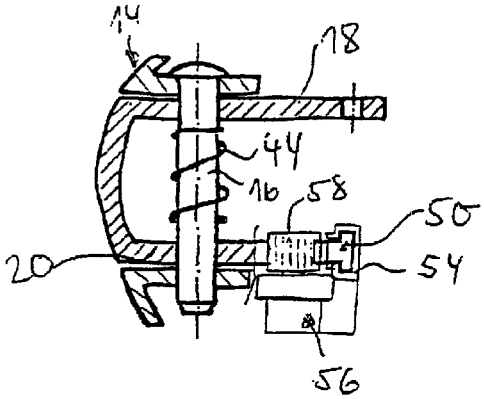
FIG. 5 shows a section taken through the assembly of FIG. 4 along lines 5—5.

The rotary damper in the embodiment of FIGS. 4 to 6 may also be fitted with a free-moving device.

What is claimed is:

1. An inner door lock actuator, comprising:

a rotational shaft adapted to be fixed to an automobile door;

a handle formed as a lever pivotably mounted on said rotational shaft;

a reset spring for biasing said handle into a rest position; and a linear damper for damping a movement of said handle into the rest position, said linear damper having opposite ends one of which is adapted to be linked to the automobile door and the other is linked to said handle;

wherein said reset spring is disposed in a housing of said damper and said reset spring is made of wire coated with plastic material.

2. The inner door lock actuator of claim 1, further comprising an actuator housing adapted to be attached to the automobile door, said rotational shaft being fixed to said housing.

3. The inner door lock actuator of claim 2, further comprising a linkage which is led to a door lock of the automobile door, said linkage engaging said handle.

4. The inner door lock actuator of claim 1, wherein said reset spring is disposed between the opposite ends of said linear damper and biases the opposite ends into a relative position corresponding to the rest position of said handle.

5. An actuator for a door lock of a door, comprising:

a rotational shaft adapted to be fixed to the door;

a handle formed as a lever pivotably mounted on said rotational shaft;

a reset spring element for biasing said handle into a rest position; and a damper for damping a return movement of said handle into the rest position, said damper including a rod pivotally attached to said handle by a hinge;

wherein said damper further includes a cylinder and a piston reciprocally moveable within said cylinder, said rod being a piston rod having opposite ends one of which is attached to said piston and the other is pivotally attached to said handle by said hinge.

6. The actuator of claim 5, wherein said damper further includes another hinge adapted to pivotally attach said cylinder to the door.

7. The actuator of claim 5, wherein said reset spring element biases said piston rod and said cylinder into a relative position corresponding to the rest position of said handle.

8. The actuator of claim 5, wherein said reset spring element is positioned within said cylinder between said piston and an end wall of said cylinder, and biases said piston and said cylinder into a relative position corresponding to the rest position of said handle.

9. The actuator of claim 8, wherein said reset spring element is made of wire coated with plastic material.

10. The actuator of claim 5, further comprising a linkage adapted to connect the door lock and said handle, said linkage having a portion that directly engages said handle and extends substantially parallel to said piston rod.

11. The actuator of claim 5, wherein said damper further includes a ring disposed between said piston and a side wall of said cylinder, said ring being configured to allow a fluid in said cylinder to pass through said ring more easily in a direction corresponding to an actuating movement of said handle away from the rest position than in an opposite direction corresponding to the return movement of said handle into the rest position.

12. An actuator for a door lock of a door, comprising:

a rotational shaft adapted to be fixed to the door;

a handle formed as a lever pivotably mounted on said rotational shaft;

a reset spring element for biasing said handle into a rest position; and a damper for damping a return movement of said handle into the rest position, said damper including a rod pivotally attached to said handle by a hinge;

wherein said damper further includes a rotary damper having a pinion, said rod having opposite ends one of which has a gear segment meshing with said pinion and the other is pivotally attached to said handle by said hinge.

13. The actuator of claim 12, further comprising guide means for holding said gear segment in engagement with said pinion.

14. The actuator of claim 12, wherein said reset spring element is disposed on said rotational shaft, said reset spring element having one end engaging said handle and an opposite end adapted to engage the door.

15. The actuator of claim 12, wherein an actuating movement of said handle away from the rest position simultaneously moves said rod linearly and pivotally.

16. The actuator of claim 12, further comprising a guide portion holding said gear segment in engagement with said pinion, said guide portion being pivotally supported on said rotary damper.

17. In combination, an automobile door having a door lock and an inner actuator for the door lock, said inner actuator comprising:

an actuator housing fixed to said automobile door;

a handle formed as a lever pivotably supported by said actuator housing;

a reset spring for biasing said handle into a rest position; and a damper for damping a return movement of said handle into the rest position, said damper including a rod pivotally attached to said handle by a hinge;

wherein said damper further includes a cylinder and a piston reciprocally moveable within said cylinder, said rod being a piston rod having opposite ends one of which is attached to said piston and the other is pivotally attached to said handle by said hinge.

18. The combination of claim 17, wherein said cylinder is pivotally attached to said door by another hinge.

19. The combination of claim 17, wherein said reset spring is positioned within said cylinder between said piston and an end wall of said cylinder, biases said piston and said cylinder into a relative position corresponding to the rest position of said handle, and is made of wire coated with plastic material.

20. The combination of claim 17, further comprising a linkage connects the door lock and said handle, said linkage having a portion that directly engages said handle and extends substantially parallel to said piston rod.

21. The combination of claim 17, wherein said damper further includes a ring disposed between said piston and a side wall of said cylinder, said ring being configured to allow a fluid in said cylinder to pass through said ring more easily in a direction corresponding to an actuating movement of said handle away from the rest position than in an opposite direction corresponding to the return movement of said handle into the rest position.

22. In combination, an automobile door having a door lock and an inner actuator for the door lock, said inner actuator comprising:

an actuator housing fixed to said automobile door;

a handle formed as a lever pivotably supported by said actuator housing;

a reset spring for biasing said handle into a rest position; and a damper for damping a return movement of said handle into the rest position, said damper including a rod pivotally attached to said handle by a hinge;

wherein said damper further includes a rotary damper having a pinion, said rod having opposite ends one of which has a gear segment meshing with said pinion and the other is pivotally attached to said handle by said hinge.

23. The combination of claim 22, further comprising guide means for holding said gear segment in engagement with said pinion.

24. The combination of claim 22, wherein said reset spring is disposed on a rotational shaft which is fixed to said actuator housing and about which said handle pivots, said reset spring having one end engaging said handle and an opposite end engaging said actuator housing.

25. The combination of claim 22, further comprising a guide portion holding said gear segment in engagement with said pinion, said guide portion being pivotally supported on said rotary damper.

* * * * *